US008202153B2

(12) United States Patent
Baerlocher

(10) Patent No.: US 8,202,153 B2
(45) **Date of Patent: *Jun. 19, 2012**

(54) GAMING DEVICE HAVING WAGER DEPENDENT BONUS GAME PLAY

(75) Inventor: Anthony J. Baerlocher, Reno, NV (US)

(73) Assignee: IGT, Reno, NV (US)

( * ) Notice: Subject to any disclaimer, the term of this patent is extended or adjusted under 35 U.S.C. 154(b) by 1192 days.

This patent is subject to a terminal disclaimer.

(21) Appl. No.: 12/014,354

(22) Filed: Jan. 15, 2008

(65) Prior Publication Data

US 2008/0113759 A1 May 15, 2008

Related U.S. Application Data

(63) Continuation of application No. 09/960,880, filed on Sep. 21, 2001, now Pat. No. 7,329,179.

(51) Int. Cl.
*A63F 9/24* (2006.01)

(52) U.S. Cl. ..... 463/20; 463/16; 463/17; 463/18; 463/19; 463/25

(58) Field of Classification Search ..... 463/16–21, 463/25–26

See application file for complete search history.

(56) References Cited

U.S. PATENT DOCUMENTS

| | | | |
|---|---|---|---|
| 4,624,459 | A | 11/1986 | Kaufman |
| 4,669,731 | A | 6/1987 | Clarke |
| 4,695,053 | A | 9/1987 | Vazquez, Jr. et al. |
| 4,991,848 | A | 2/1991 | Greenwood et al. |
| 5,116,055 | A | 5/1992 | Tracy |
| 5,344,144 | A | 9/1994 | Canon |
| 5,377,973 | A | 1/1995 | Jones et al. |
| 5,397,125 | A | 3/1995 | Adams |
| 5,511,781 | A | 4/1996 | Wood et al. |
| 5,584,764 | A | 12/1996 | Inoue |

(Continued)

FOREIGN PATENT DOCUMENTS

EP 106 749 1 1/2001

(Continued)

OTHER PUBLICATIONS

Black Swan Wagering Description and Paytable written by IGT, published prior to 2001.

(Continued)

*Primary Examiner* — Peter DungBa Vo
*Assistant Examiner* — Bach Hoang
(74) *Attorney, Agent, or Firm* — Neal Gerber & Eisenberg LLP

(57) ABSTRACT

In one primary embodiment of the present invention, the player must wager a number of paylines to qualify for one of a plurality of bonus games. The highest required number of paylines qualifies the player to play the main or most elaborate bonus game. The main or first bonus game preferably has the highest average payout per credit wagered. This provides an incentive to the player to play the highest required number of paylines. In an embodiment, any number of paylines less than the highest required number or max lines qualifies the player to play a second bonus game. The second bonus game has an average payout per credit wagered that is slightly less than the main bonus game. This allows the incentive or disparity between payouts to be set by the game designer so that the player not wagering max lines or the highest required number is not overly disadvantaged.

28 Claims, 5 Drawing Sheets

U.S. PATENT DOCUMENTS

| | | | | |
|---|---|---|---|---|
| 5,611,535 | A | 3/1997 | Tiberio | |
| 5,645,485 | A | 7/1997 | Clapper, Jr. | |
| 5,722,891 | A | 3/1998 | Inoue | |
| 5,769,716 | A | 6/1998 | Saffari et al. | |
| 5,817,172 | A | 10/1998 | Yamada et al. | |
| 5,823,874 | A | 10/1998 | Adams | |
| 5,910,048 | A | 6/1999 | Feinberg | |
| 5,967,893 | A | 10/1999 | Lawrence et al. | |
| 5,993,316 | A | 11/1999 | Coyle et al. | |
| 6,004,207 | A | 12/1999 | Wilson, Jr. et al. | |
| 6,012,983 | A | 1/2000 | Walker et al. | |
| 6,062,980 | A | 5/2000 | Luciano | |
| 6,102,400 | A | 8/2000 | Scott et al. | |
| 6,110,041 | A | 8/2000 | Walker et al. | |
| 6,113,098 | A | 9/2000 | Adams | |
| 6,126,542 | A | 10/2000 | Fier | |
| 6,155,925 | A * | 12/2000 | Giobbi et al. | 463/20 |
| 6,158,741 | A | 12/2000 | Koelling | |
| 6,159,095 | A | 12/2000 | Frohm et al. | |
| 6,159,097 | A * | 12/2000 | Gura | 463/20 |
| 6,159,098 | A * | 12/2000 | Slomiany et al. | 463/25 |
| 6,168,522 | B1 | 1/2001 | Walker et al. | |
| 6,168,523 | B1 | 1/2001 | Piechowiak et al. | |
| 6,174,233 | B1 | 1/2001 | Sunaga et al. | |
| 6,174,235 | B1 | 1/2001 | Walker et al. | |
| 6,186,894 | B1 * | 2/2001 | Mayeroff | 463/20 |
| 6,203,429 | B1 | 3/2001 | Demar et al. | |
| 6,210,277 | B1 | 4/2001 | Stefan | |
| 6,224,482 | B1 | 5/2001 | Bennett | |
| 6,224,483 | B1 | 5/2001 | Mayeroff | |
| 6,227,969 | B1 | 5/2001 | Yoseloff | |
| 6,227,971 | B1 | 5/2001 | Weiss | |
| 6,231,442 | B1 | 5/2001 | Mayeroff | |
| 6,231,445 | B1 | 5/2001 | Acres | |
| 6,234,897 | B1 | 5/2001 | Frohm et al. | |
| 6,238,287 | B1 | 5/2001 | Komori et al. | |
| 6,244,957 | B1 | 6/2001 | Walker et al. | |
| 6,251,013 | B1 | 6/2001 | Bennett | |
| 6,254,481 | B1 * | 7/2001 | Jaffe | 463/20 |
| 6,254,482 | B1 | 7/2001 | Walker et al. | |
| 6,270,409 | B1 | 8/2001 | Shuster | |
| 6,299,165 | B1 | 10/2001 | Nagano | |
| 6,302,791 | B1 | 10/2001 | Frohm et al. | |
| 6,309,299 | B1 | 10/2001 | Weiss | |
| 6,312,331 | B1 | 11/2001 | Tamaki | |
| 6,315,662 | B1 | 11/2001 | Jorasch et al. | |
| 6,336,862 | B1 | 1/2002 | Byrne | |
| 6,358,147 | B1 | 3/2002 | Jaffe et al. | |
| 6,419,578 | B1 | 7/2002 | Moody et al. | |
| 6,428,412 | B1 | 8/2002 | Anderson et al. | |
| 6,471,208 | B2 * | 10/2002 | Yoseloff et al. | 273/143 R |
| 6,482,089 | B2 * | 11/2002 | DeMar et al. | 463/20 |
| 6,506,117 | B2 * | 1/2003 | DeMar et al. | 463/20 |
| 6,508,707 | B2 * | 1/2003 | DeMar et al. | 463/16 |
| 6,520,855 | B2 * | 2/2003 | DeMar et al. | 463/20 |
| 6,569,016 | B1 | 5/2003 | Baerlocher | |
| 6,656,040 | B1 | 12/2003 | Brosnan et al. | |
| 6,939,226 | B1 * | 9/2005 | Joshi | 463/20 |
| 6,974,385 | B2 * | 12/2005 | Joshi et al. | 463/20 |
| 7,029,395 | B1 | 4/2006 | Baerlocher | |
| 7,195,560 | B2 * | 3/2007 | DeMar et al. | 463/20 |
| 7,329,179 | B2 * | 2/2008 | Baerlocher | 463/20 |
| 7,374,486 | B2 * | 5/2008 | Baerlocher | 463/20 |
| 7,452,271 | B2 * | 11/2008 | DeMar et al. | 463/20 |
| 7,465,227 | B2 * | 12/2008 | Baerlocher | 463/16 |
| 7,470,185 | B2 * | 12/2008 | Baerlocher | 463/16 |
| 7,666,091 | B2 * | 2/2010 | Joshi et al. | 463/25 |
| 7,828,643 | B2 * | 11/2010 | Baerlocher | 463/20 |
| 7,934,989 | B2 * | 5/2011 | Joshi et al. | 463/20 |
| 7,976,378 | B2 * | 7/2011 | Baerlocher | 463/20 |
| 2005/0119047 | A1 * | 6/2005 | Olive | 463/27 |
| 2005/0176488 | A1 * | 8/2005 | Olive | 463/16 |
| 2008/0194316 | A1 | 8/2008 | Baerlocher | |
| 2008/0214280 | A1 | 9/2008 | Baerlocher | |
| 2009/0264193 | A1 * | 10/2009 | Vancura et al. | 463/30 |

FOREIGN PATENT DOCUMENTS

| | | |
|---|---|---|
| WO | WO 85/00910 | 2/1985 |

OTHER PUBLICATIONS

Christensen, David G., Slot Machines a Pictorial Revew, 1976, The Vestal Press, pp. 98-99.

Fey, Marshall, Slot Machines, A Pictorial History of the first 100 Years, 1997, Liberty Belle Books, Fifth Priming, p. 88.

Free Fall Poker Brochure written by IGT, available prior to 2001.

Jazzy Jackpots Advertisement written by Atronic, published prior to 2001.

Jazzy Jackpots Article written by Strictly Slots, published Mar. 2001.

Neon Nights Advertisement written by IGT, published in 2000.

Tokenization Description written by IGT, available prior to 2001.

Vision Bonus Games Advertisement includes "Diamond Fives Buy-A-Bonus Spin," written by IGT, published 1999.

Wheel of Fortune Paytable including progressive qualification written by IGT, published in prior to 2000.

Wild Streak Brochures written by WMS Gaming, Inc., published Mar. 2001.

* cited by examiner

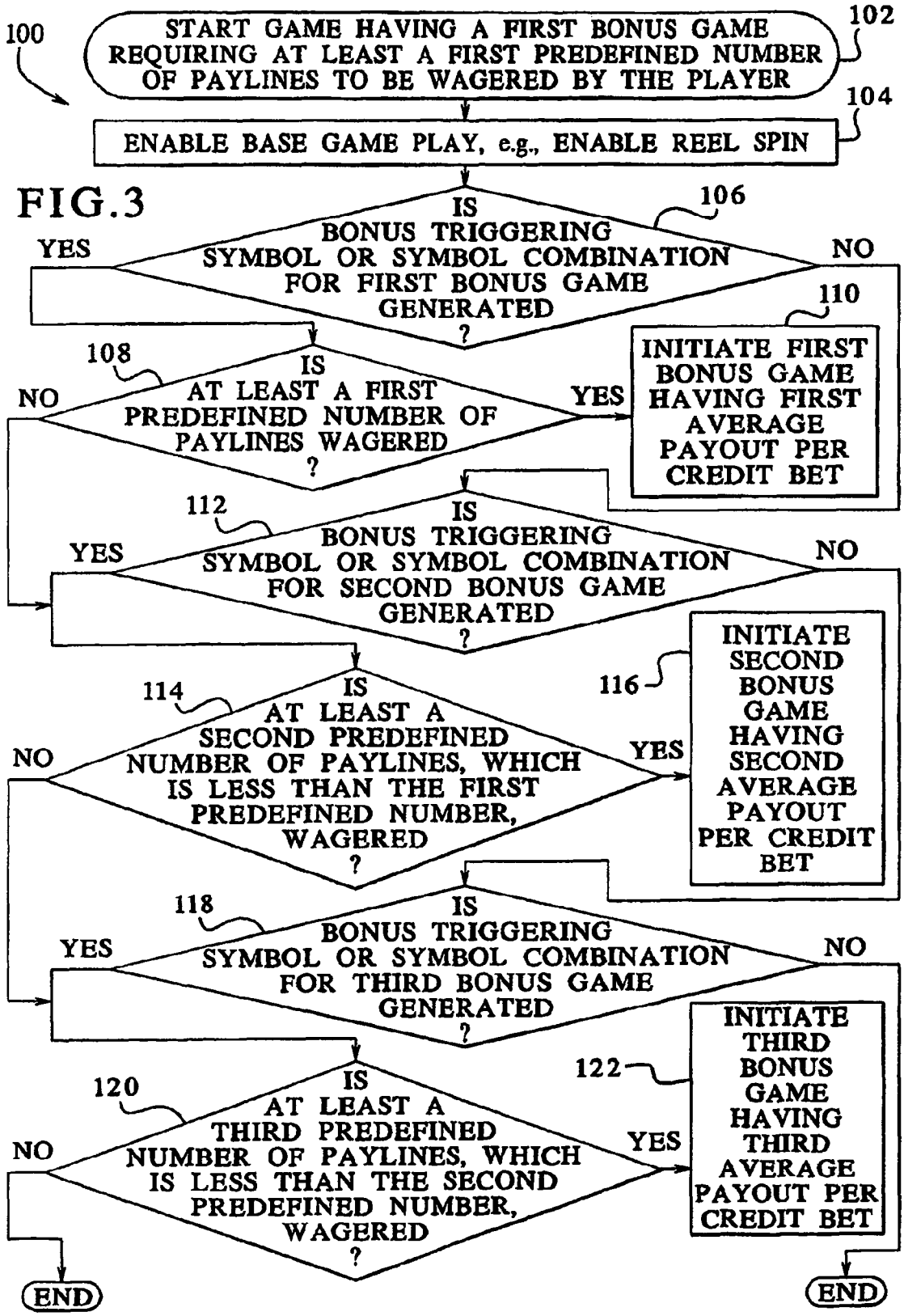
100
START GAME HAVING A FIRST BONUS GAME REQUIRING AT LEAST A FIRST PREDEFINED NUMBER OF PAYLINES TO BE WAGERED BY THE PLAYER
102
ENABLE BASE GAME PLAY, e.g., ENABLE REEL SPIN
104
FIG.3
IS BONUS TRIGGERING SYMBOL OR SYMBOL COMBINATION FOR FIRST BONUS GAME GENERATED ?
106
YES
NO
INITIATE FIRST BONUS GAME HAVING FIRST AVERAGE PAYOUT PER CREDIT BET
110
IS AT LEAST A FIRST PREDEFINED NUMBER OF PAYLINES WAGERED ?
108
NO
YES
IS BONUS TRIGGERING SYMBOL OR SYMBOL COMBINATION FOR SECOND BONUS GAME GENERATED ?
112
YES
NO
IS AT LEAST A SECOND PREDEFINED NUMBER OF PAYLINES, WHICH IS LESS THAN THE FIRST PREDEFINED NUMBER, WAGERED ?
114
NO
YES
INITIATE SECOND BONUS GAME HAVING SECOND AVERAGE PAYOUT PER CREDIT BET
116
IS BONUS TRIGGERING SYMBOL OR SYMBOL COMBINATION FOR THIRD BONUS GAME GENERATED ?
118
YES
NO
IS AT LEAST A THIRD PREDEFINED NUMBER OF PAYLINES, WHICH IS LESS THAN THE SECOND PREDEFINED NUMBER, WAGERED ?
120
NO
YES
INITIATE THIRD BONUS GAME HAVING THIRD AVERAGE PAYOUT PER CREDIT BET
122
END
END

GAMING DEVICE HAVING WAGER DEPENDENT BONUS GAME PLAY

PRIORITY CLAIM

This application is a continuation application of U.S. patent application Ser. No. 09/960,880, filed on Sep. 21, 2001, entitled "Gaming Device Having Wager Dependent Bonus Game Play," the entire contents of which are hereby fully incorporated herein by reference.

CROSS REFERENCE TO RELATED APPLICATIONS

This application relates to the following co-pending, commonly owned applications: "GAMING DEVICE HAVING A WEIGHTED PROBABILITY FOR SELECTING A BONUS GAME," Ser. No. 11/534,049; "GAMING DEVICE HAVING A REPLICATING DISPLAY THAT PROVIDES WINNING PAYLINE INFORMATION," Ser. No. 11/114,425; "GAMING DEVICE HAVING A REPLICATING DISPLAY THAT PROVIDES WINNING PAYLINE INFORMATION," Ser. No. 11/856,706; "GAMING DEVICE HAVING AN INPUT-OUTPUT VALUE BONUS SCHEME," Ser. No. 10/803,309; "GAMING DEVICE HAVING ODDS OF WINNING WHICH INCREASE AS A PLAYER'S WAGER INCREASES," Ser. No. 11/242,157; "GAMING DEVICE HAVING A CASH OUT MENU SCREEN AND A SYSTEM AND METHOD FOR ENABLING A PLAYER TO RETRIEVE MONEY FROM A GAMING DEVICE," Ser. No. 10/767,243; "GAMING DEVICE HAVING A CASH OUT MENU SCREEN AND A SYSTEM AND METHOD FOR ENABLING A PLAYER TO RETRIEVE MONEY FROM A GAMING DEVICE," Ser. No. 11/014,078; "GAMING DEVICE AND METHOD FOR ACTIVATING MULTIPLE PAYLINES UPON THE WAGER OF A SINGLE CREDIT," Ser. No. 09/972,616; and "GAMING DEVICE PROVIDING TOURNAMENT ENTRIES," Ser. No. 10/926,811.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufactures have long provided gaming machines and particularly slot machines employing a plurality of reels, wherein the reels each have a plurality of symbols. In these games, the player spins a number of reels to produce a random generation of a combination of symbols. If the generated combination, or a portion of the combination, matches one of a number of predetermined award producing or winning combinations, the player receives an award.

To increase player enjoyment and excitement, and to increase the popularity of the gaming machines, gaming device manufacturers constantly strive to provide players with new types of gaming machines that attract the player and keep the player entertained. One proven way manufacturers use to make their machines more popular is to increase the number and variety of winning combinations and provide more opportunities for the player to win. Providing more variety and opportunities holds the player's interest for a longer time and also enables the manufacturer to have a larger range of payouts for the winning combinations. The larger range increases the size of the largest possible payout of the gaming device. Large payouts tend to attract players.

One avenue that manufacturers have taken to provide more variety, opportunity, enjoyment and excitement has been to increase the number of paylines. Paylines are the lines of symbol positions or paystops that the machine analyzes to determine if the player has won an award. Original gaming machines had only one payline. Modern machines, sometimes called "line" machines, have multiple paylines that form combinations of reel symbols for the gaming device to analyze.

Machines having at least three reels and displaying at least three rows of symbols can have diagonal paylines. Machines having five reels and displaying at least three rows have many possible paylines, wherein the only criterion is that each symbol of a payline must be adjacent to at least one other symbol of the payline. Consequently, certain known gaming machines can have twenty-five different paylines, wherein a player can make up to twenty-five different bets each time the player spins the reels.

Multiple paylines present multiple opportunities for the player to obtain a winning combination of symbols. Usually, players have to wager more to obtain the benefit of the multiple lines. Many games provide a bonus jackpot for playing the maximum number paylines ("max lines") and/or the maximum number of coins per payline ("max coins"). Many newer games that have bonus games also require that the player wager max lines or max credits to be eligible for or to qualify for the bonus game or a jackpot. Certain players, however, do not wish to wager an amount necessary to play max lines or max credits.

As bonus games, in particular, have become and will continue to become more popular and more prevalent, they have taken and will continue to take up more of the overall payout percentage for the gaming device. That is, a game designer must account for the average bonus game payout and the percentage of the time that the player obtains this average payout in determining the overall payout percentage for the machine. It is not unreasonable that a bonus game can account for thirty percent of the total payout percentage. This number is also likely to increase.

A player who does not wager enough to qualify for bonus game play therefore loses this potentially increasing slice of the payout percentage. Such players play the gaming machine at what is commonly termed the "base" payout percentage, which equals the total winning percentage less the payout percentage of the bonus game. Requiring max lines or max credits for the bonus rewards a higher payout percentage to a player making such a wager. A need therefore exists for a game scheme that enables game designers to provide a fun and valuable bonus game to the player, require that the player wager max lines or max credits to qualify for the bonus game and provide a desired but not excessive disparity in the payout percentage between eligible and non-eligible players.

One solution has been to provide a payout to the player who wagers less than max lines or max credits but achieves the symbol combination along an active payline that would otherwise trigger the bonus game. For example, if three cherries trigger the bonus game when the player wagers max lines, the game employing the known solution would pay a certain amount times the coins wagered when the player plays less than max lines. The amount is calculated in the following manner. If a bonus game, for example, pays out twenty coins or credits per coin wagered, on average, then the bonus triggering combination pays out preferably slightly less than twenty coins, e.g., eighteen coins, per coin wagered when less than all lines are wagered. In this way, the game adds a percentage, i.e., 90%, of the bonus game's contribution back to the overall payout percentage.

The problem inherent in this known solution is that wagering less than all paylines guarantees the above described payout, while many bonus games come with no such guarantee. Certain bonus games involve risk and chance and in many cases very high payouts with very low winning percentages. The player may therefore achieve a payout significantly less than average in the bonus game. In such a case, the player would have been better off to wager less than max credits or max lines. This creates a disincentive to play max coins or max lines to qualify for the bonus game, which in turn deprives the player of the enjoyment and excitement of playing such game.

If the game designer attempts to guarantee a certain payout percentage in the bonus game, e.g., sixteen coins per coin wagered, then the average payout for the bonus game rises, an even larger slice of the total payout percentage now comes from the bonus game, and the player not wagering max lines is again disadvantaged. Accordingly, another solution is needed.

SUMMARY OF THE INVENTION

The present invention provides a processor controlled gaming device that has a plurality of bonus games. In one primary embodiment, the player must wager on a number of paylines to qualify for each of the bonus games. The highest required number of paylines qualifies the player to play the main or most elaborate bonus game. The main or first bonus game preferably has the highest average payout per credit wagered. This provides an incentive to the player to play the highest required number of paylines. In one preferred embodiment, the highest required number of paylines is each payline of the gaming device or the "max lines." In another embodiment, the highest required number of paylines is less than the maximum number of lines.

In one embodiment, any number of paylines less than the highest required number or max lines qualifies the player to play a second bonus game. The second bonus game has an average payout per credit wagered that is slightly less than the main bonus game. This allows the incentive or disparity between payouts to be set by the game designer so that the player not wagering max lines or the highest required number is not overly disadvantaged.

In another embodiment, the second bonus game has a threshold level of paylines that the player must wager to qualify for the second bonus game. In this case, any number of paylines wagered less than this second threshold qualifies the player for a third bonus game, which preferably has a payout slightly less than the second bonus game. In this manner, the game designer can stack as many bonus games as desired on various payline wagers to achieve a desired payout profile.

In one embodiment, the same symbol or combination of symbols triggers each payline dependent bonus game. In another embodiment, each bonus game has its own triggering symbol or combination. In a further embodiment, any combination of bonus games may share two or more symbols or symbol combinations. Each triggering symbol or combination, however, preferably has the same probability or likelihood of being generated, so that no bonus game is more or less likely to occur than any other bonus game. That is, the player's wager determines which bonus game, if any, is played.

In another primary embodiment, the player must wager a predefined number of credits to qualify for each of the bonus games. The highest required number of credits qualifies the player to play the main or most elaborate bonus game, which preferably has the highest average payout per credit wagered. In one preferred embodiment, the highest required number of credits is the maximum wager on all paylines or the "max bet." In another embodiment, the highest required number of credits is less than the maximum wager on all the paylines.

In one embodiment, any number of credits less than the highest required number or max bet qualifies the player to play a second bonus game. The second bonus game has an average payout per credit wagered that is equal to or slightly less than the main bonus game, which allows the game designer to set the incentive or disparity between payouts.

In another embodiment, the second bonus game also has a qualifying threshold level of credits that the player must wager, albeit lower than the first number or max credits. In this case, any number of credits wagered less than this second threshold qualifies the player for a third bonus game, which preferably has a payout slightly less than the second bonus game. In this manner, the game designer can stack bonus games based on the number of credits wagered to achieve a desired payout profile.

In one embodiment, the same symbol or combination of symbols is used to trigger each credit dependent bonus game of the gaming device. In another embodiment, each bonus game may have its own triggering symbol or combination or any combination of bonus games may share two or more symbols or symbol combinations. Each triggering symbol or combination, however, preferably has the same probability or likelihood of being generated, so that no bonus game is more or less likely to occur than any other game.

It is therefore an advantage of the present invention to provide a gaming device that has a payline or credit wager requirement to initiate a main bonus game.

Another advantage of the present invention is to provide a gaming device having payline or credit wager dependent bonus games so that the player wagering less is not overly disadvantaged by doing so.

A further advantage of the present invention is to provide a gaming device having payline or credit wager dependent bonus games that provide some incentive to make higher wagers.

Yet another advantage of the present invention is to provide a gaming device having payline or credit wager dependent bonus games that each have an average payout per credit wagered rather than a guaranteed payout per credit wagered.

Other objects, features and advantages of the invention will be apparent from the following detailed disclosure, taken in conjunction with the accompanying sheets of drawings, wherein like numerals refer to like parts, elements, components, steps and processes.

BRIEF DESCRIPTION OF THE DRAWINGS

FIG. 3 is a process flow diagram of one embodiment in which the game requires a number of paylines to be wagered to qualify for a main bonus game.

DETAILED DESCRIPTION OF THE INVENTION

Figure 1A:
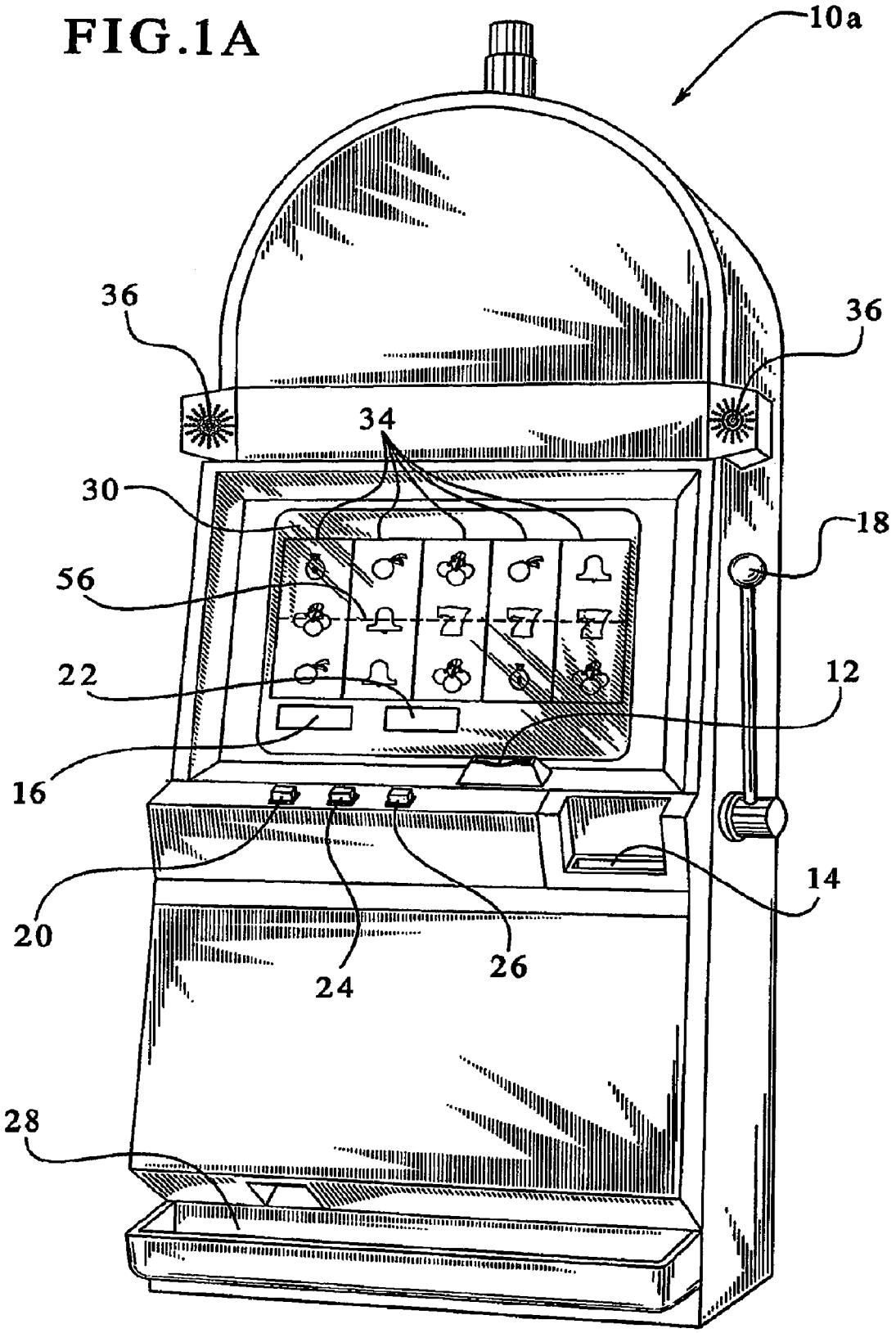
FIGS. 1A and 1B are perspective views of alternative embodiments of the gaming device of the present invention.
Figure 1B:
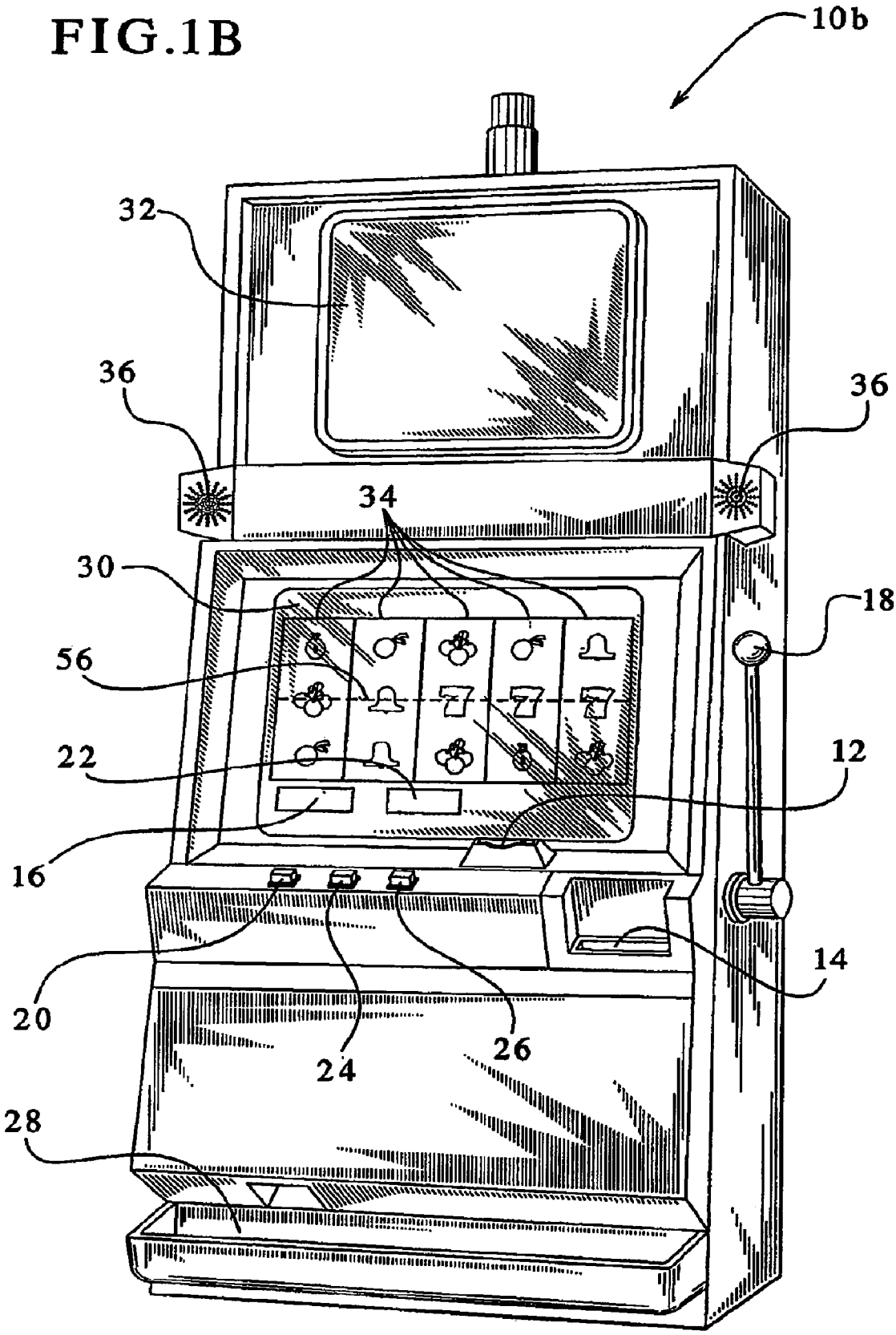

Referring now to the drawings, and in particular to FIGS. 1A and 1B, gaming device 10*a* and gaming device 10*b* illustrate two possible cabinet styles and display arrangements and are collectively referred to herein as gaming device 10. The present invention involves the triggering of one of a plurality of bonus games based on the player's wager in a base game. When the base game of the present invention is slot, gaming device 10 has the controls, displays and features of a conventional slot machine, wherein the player operates the gaming device while standing or sitting. Gaming device 10 also includes being a pub-style or table-top game (not shown), which a player operates while sitting.

The base games of the gaming device 10 include slot, poker, blackjack or keno, among others. The symbols and indicia used for any of these base games or any of their bonus games include mechanical, electrical or video symbols and indicia. Each of these base games also have monetary input devices. FIGS. 1A and 1B illustrate a coin slot 12 for coins or tokens and/or a payment acceptor 14 for cash money. The payment acceptor 14 also includes other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one. At any time during the game, a player may "cash out" by pushing a cash out button 26 to receive coins or tokens in the coin payout tray 28 or other forms of payment, such as an amount printed on a ticket or credited to a credit card, debit card or smart card. Well known ticket printing and card reading machines (not illustrated) are commercially available.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

The slot machine base game of gaming device 10 preferably displays a plurality of reels 34, preferably three to five reels 34, in mechanical or video form on one or more of the display devices. Each reel 34 displays a plurality of indicia such as bells, hearts, fruits, numbers, letters, bars or other images which preferably correspond to a theme associated with the gaming device 10. If the reels 34 are in video form, the display device displaying the video reels 34 is preferably a video monitor. Each base game, especially the slot machine base game of the gaming device 10, includes speakers 36 for making sounds or playing music.

Figure 2:
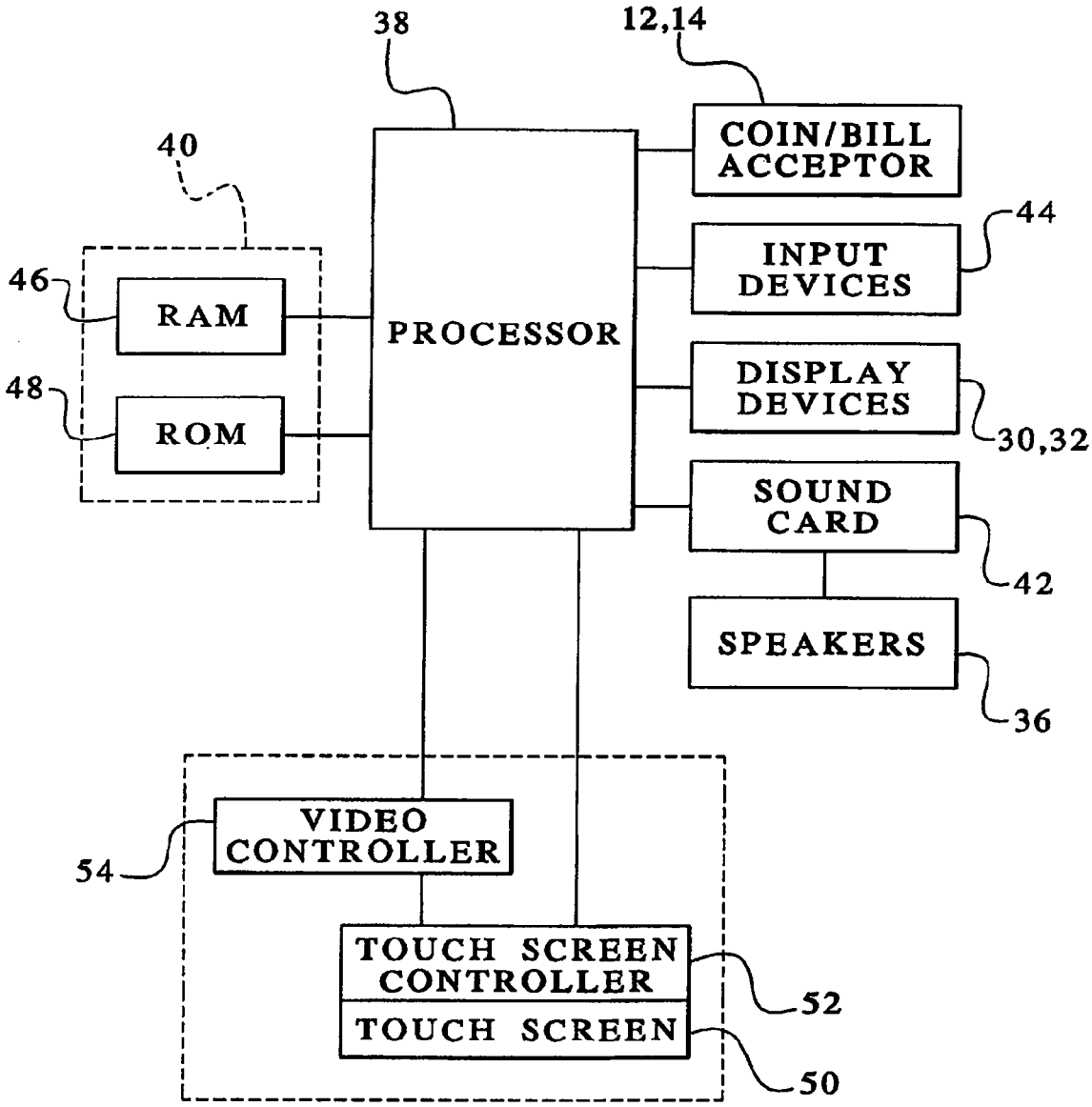
FIG. 2 is a schematic block diagram of the electronic configuration of one embodiment of the gaming device of the present invention.

Referring now to FIG. 2, a general electronic configuration of the gaming device 10 for the stand alone and bonus embodiments described above preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 includes random access memory (RAM) 46 for storing event data or other data generated or used during a particular game. The memory device 40 also includes read only memory (ROM) 48 for storing program code, which controls the gaming device 10 so that it plays a particular game in accordance with applicable game rules and pay tables.

As illustrated in FIG. 2, the player preferably uses the input devices 44 to input signals into gaming device 10. In the slot machine base game, the input devices 44 include the pull arm 18, play button 20, the bet one button 24 and the cash out button 26. A touch screen 50 and touch screen controller 52 are connected to a video controller 54 and processor 38. The terms "computer" or "controller" are used herein to refer collectively to the processor 38, the memory device 40, the sound card 42, the touch screen controller and the video controller 54.

In certain instances, it is preferable to use a touch screen 50 and an associated touch screen controller 52 instead of a conventional video monitor display device. The touch screen enables a player to input decisions into the gaming device 10 by sending a discrete signal based on the area of the touch screen 50 that the player touches or presses. As further illustrated in FIG. 2, the processor 38 connects to the coin slot 12 or payment acceptor 14, whereby the processor 38 requires a player to deposit a certain amount of money in to start the game.

It should be appreciated that although a processor 38 and memory device 40 are preferable implementations of the present invention, the present invention also includes being implemented via one or more application-specific integrated circuits (ASIC's), one or more hard-wired devices, or one or more mechanical devices (collectively referred to herein as a "processor"). Furthermore, although the processor 38 and memory device 40 preferably reside in each gaming device 10 unit, the present invention includes providing some or all of their functions at a central location such as a network server for communication to a playing station such as over a local area network (LAN), wide area network (WAN), Internet connection, microwave link, and the like.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10, including any of the base games disclosed above, also includes bonus games that give players the opportunity to win credits. The gaming device 10 preferably employs a video-based display device 30 or 32 for the bonus games. The bonus games include a program that automatically begins when the player achieves a qualifying condition in the base game.

In the slot machine embodiment, the qualifying condition includes a particular symbol or symbol combination generated on a display device. As illustrated in the five reel slot game shown in FIGS. 1A and 1B, the qualifying condition includes the number seven appearing on, e.g., three adjacent reels 34 along a payline 56. It should be appreciated that the present invention includes one or more paylines, such as payline 56, wherein the paylines can be horizontal, diagonal or any combination thereof. An alternative scatter pay qualifying condition includes the number seven appearing on, e.g., three adjacent reels 34 but not necessarily along a payline 56, appearing on any different set of reels 34 three times or appearing anywhere on the display device the necessary number of times.

The remainder of the specification explains the present invention as applied to the base game of slot. In slot, the player chooses the number of lines to play and the number of coins to play. Both of these decisions affect the outcome of the present invention, as will be explained. In a multi-hand type of poker game, the player chooses a number of hands to play. In this type of poker game, the number of hands wagered determines which bonus game the player plays. In another type of poker game, the player selects a number of coins to play per hand. In this type of poker game, the number of coins wagered determines which bonus game the player plays.

In blackjack, the player chooses a number of hands to play, wherein the number of hands wagered determines which bonus game the player plays. In keno, the player chooses a number of cards or a quantity of numbers, wherein the number of cards or numbers wagered determines which bonus game the player plays. Each of these embodiments operate according to the methods described herein.

Referring now to FIG. 3, one method 100 of the present invention generally requires the player to wager a number of paylines 56 (FIGS. 1A and 1B) to qualify or be eligible for a "main" bonus game. The main bonus game is typically a bonus game that the game designer has developed to maximize fun, excitement and enjoyment. In certain instances, these main bonus games can have very large payouts with respect to payouts typically associated with the base game. Due to these large payouts, the designer requires that the player play a certain number of paylines. Although the present invention does not intend to be limited to bonus games having large payouts, this is one normal situation in which a need for the present invention arises.

In this embodiment, requiring a number of paylines to be wagered requires the player to wager at least one credit on each payline 56. The minimum wager to qualify for the main bonus game is thus a number of credits equal to the number of required paylines. In many games, however, the player is allowed to wager multiple credits on each active or wagered payline. This embodiment does not require or count a total number of credits wagered by the player, so if a game requires that the player wager at least eight of nine total paylines 56 (i.e., minimum of eight credits) and the player wagers five credits on two paylines (i.e., ten total credits), the player does not qualify for the main bonus game.

Thus, in the method 100, a base game, e.g., a slot game, starts and has a first or main bonus game that requires at least a first predefined number of paylines 56 (e.g., eight of nine total) to be wagered by the player, as indicated by oval 102. Once the player inserts an appropriate amount of money into the base game, as described above, the gaming device 10 enables base game play, e.g., enables a spin of the reels 34, as described above and as indicated by block 104.

The gaming device 10 determines whether a bonus triggering symbol or set of symbols for the first or main bonus game appears along a payline 56 or in a scatter arrangement, as indicated by the diamond 106. That is, the gaming device 10 may look for a certain symbol or symbol combination: (i) on an active or wagered payline, which is preferred; (ii) on any payline 56, active or otherwise; or (iii) in any scattered arrangement on the display device 30 or 32. In one implementation, gaming device 10 requires a bonus game triggering combination of two or more symbols. In another implementation, gaming device 10 requires only a single bonus game triggering symbol.

If the base game play or spin of the reels 34 does not result in a bonus game triggering symbol or combination for the first bonus game, gaming device 10 determines in one embodiment whether a symbol or combination for a second bonus game has been generated, as indicated by diamond 112. It should be appreciated that, in one preferred embodiment, the game only employs one triggering symbol or combination. Or, the game may use a plurality of symbol combinations that each trigger each bonus game. Diamond 112 illustrates a third possibility wherein different bonus games have different and unique triggering symbols or combinations.

If a triggering symbol or combination for the first bonus game is generated, gaming device 10 determines whether the player has wagered at least the first predetermined number of paylines 56 (e.g., eight of nine), as indicated by diamond 108. If so, gaming device 10 initiates the first or main bonus game, which has a first average payout per credit bet, as indicated by block 110.

The first or main bonus game is preferably in accord with a theme of the gaming device 10. Being the main bonus game, it is likely to be the most complex, have the most interesting and intricate graphics and associated sound and have the highest average payout per credit wagered. Many bonus games payout a multiplier that multiplies the player's total bet, i.e., the total credits wagered on each payline. In such a case "the average payout per credit wagered" as it is used in block 110 is a "true" average payout per credit wagered because as the player's wager increases, the payout increases.

Other bonus games payout a number of base game credits or credits that is independent of the player's bet. Here, once the player wagers the first required number of paylines (e.g., eight of nine), the player can win the same credits in the bonus game regardless of whether the player wagers one credit per line, two credits per line, etc. In this case, "the average payout per credit wagered" as it is used in block 110 is actually the average payout per the minimum required bet, i.e., one credit on each required payline. For purposes of the present invention, the term "average payout per credit wagered" includes both the true average and the minimum bet average and therefore includes both types of bonus games.

If a triggering symbol or combination for the first bonus game is generated, but the player has not wagered at least the first predetermined number of paylines 56 (e.g., eight of nine), gaming device 10 determines whether the player has wagered at least a second, lesser, predefined number of paylines 56 (e.g., six of nine), as indicated by diamond 114. If so, gaming device 10 initiates a second bonus game, which has a second average payout per credit bet, as indicated by block 116. The second average payout is preferably less than the first average payout per credit bet so that there remains a slight incentive to wager the higher number of paylines 56.

Also, if the first symbol or combination is not generated, as determined in connection with diamond 106, but a second symbol or combination for the second bonus game has been generated, as indicated by diamond 112, and at least the second predefined number of paylines has been wagered, as determined in connection with diamond 114, the gaming device 10 initiates the second bonus game, which has the second average payout per credit bet, as indicated by block 116. Thus, the second bonus game in one embodiment is generated by the same symbol or combination as is the first bonus game. In another embodiment, the second bonus game has its own triggering symbol or combination. Preferably, both embodiments would not be included in the same gaming device 10. For purposes of illustration, however, the method 100 includes both embodiments.

Since one of the goals of the present invention is to compensate the player who does not wager the first predefined number of paylines 56 by allowing the player to play a second bonus game having a second and preferably slightly smaller average payout, the probability of generating the first symbol or combination ("first bonus trigger") is preferably the same as that for generating the second symbol or combination ("second bonus trigger"). If the second trigger is easier to achieve, the second bonus game occurs more often, which provides a disincentive to wager the higher number of paylines. If the second trigger is harder to achieve, the second bonus game occurs less often, which tends to defeat the purpose of providing the second bonus, i.e., to compensate the player.

The second trigger does not have to have the same likelihood of generation as the first trigger, but the likelihoods are preferably the same. The second bonus game preferably occurs with the same frequency as does the first or main bonus game. However, the same symbol or symbol combination does not have to be used for both games. It is well known in the art to have different symbols or combinations with the same probability. The same symbol or symbol combination can, however, be used for both games and for each bonus game incorporated into gaming device 10. The present invention includes each of these scenarios.

These scenarios also exist for the third bonus game, as indicated by diamonds 118 and 120 and block 122. If one of either the first or second bonus triggers has occurred, as determined in connection with diamonds 106 and 112, respectively, but neither the first or second predefined number of paylines has been wagered, as determined in connection with diamonds 108 and 114, respectively, the game determines whether the player has wagered a third predefined number paylines, as indicated by diamond 120, which is less than the second predefined number (e.g., four of nine). If so, gaming device 10 initiates a third bonus game, which has a third average payout per credit bet, as indicated by block 122. The third average payout is preferably less than the second average payout per credit bet so that there remains a slight incentive to wager the higher number of paylines 56.

As described above, if the first or second triggers are not generated, as determined in connection with diamonds 106 and 112, respectively, but a third symbol or combination for the third bonus game has been generated, as indicated by diamond 118, and at least the third predefined number of paylines has been wagered, as determined in connection with diamond 120, the gaming device 10 initiates the third bonus game, which has the third average payout per credit bet, as indicated by block 122. The third bonus game in one embodiment is generated by the same symbol or combination as is the first or second bonus games. In another embodiment, the third bonus game has its own triggering symbol or combination. Preferably, again, only one of these embodiments is included in the same gaming device 10.

It should be appreciated that the payline dependent bonus game embodiments can include more than three bonus games and is limited in number only by the total number of paylines. If gaming device 10 has nine paylines, it can have nine different bonus games, each initiated depending on the number of paylines wagered and either by its own trigger or by a trigger shared with one or more other bonus games. To illustrate this feature, dotted lines are shown leading from diamonds 118 and 120 to an end of the gaming scheme of method 100. Preferably, each trigger has the same probability or likelihood of being generated.

In one preferred embodiment, the first predefined number of paylines, discussed in connection with the oval 102, is the total number of paylines or "max lines" as is commonly used in the industry. That is, a five payline gaming device 10 requires max lines or all five paylines to be wagered to qualify the player for the first or main bonus game. A twenty-five payline gaming device 10 requires max lines or all twenty-five paylines to be wagered to qualify the player for the first or main bonus game, etc. The second and third bonus games, etc., in the preferred embodiment require less than max lines to be wagered.

Figure 4:
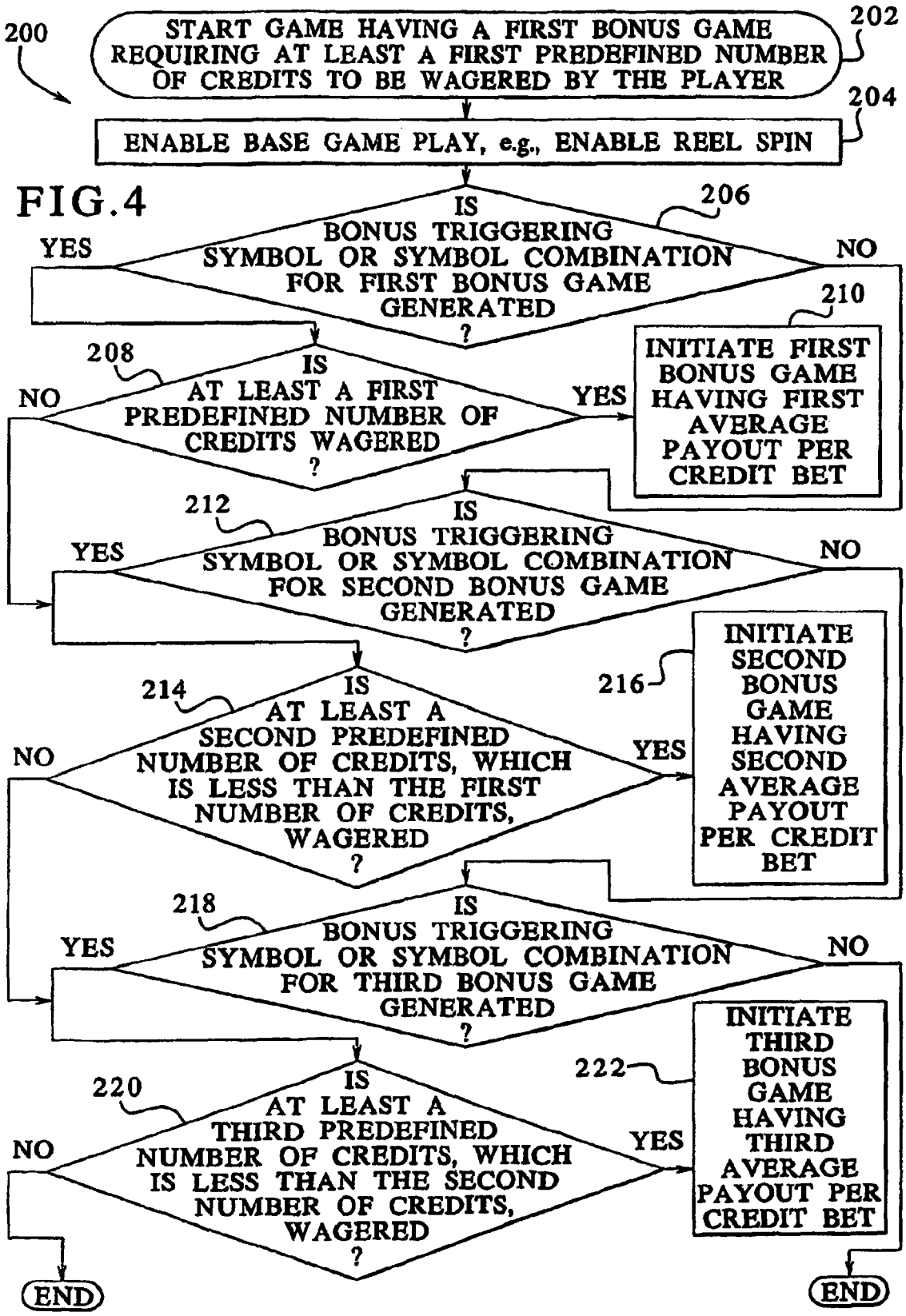
FIG. 4 is a process flow diagram of one embodiment in which the game requires a number of credits to be wagered to qualify for a main bonus game.

Referring now to FIG. 4, one method 200 requires the player to wager a number of credits to qualify or be eligible for the "main" bonus game. This wager or credit method 200 operates in many respects the same as the payline method 100 previously described. The main bonus game is again preferably the bonus game that the game designer has developed to maximize fun, excitement and enjoyment.

In the wager or credit embodiments, requiring a number of credits to be wagered requires the player to wager the credits on any number of paylines 56. This embodiment does not require or count a total number of paylines wagered by the player, so if a game requires that the player wager at least twenty total credits or credits, it does not matter whether the player wagers one credit on twenty paylines 56 or five credits on four paylines 56.

In the method 200, a base game, e.g., a slot game, begins with a first or main bonus game that requires at least a first predefined number of credits to be wagered by the player, as indicated by oval 202. Once the player inserts an appropriate amount of money into the base game, the gaming device 10 enables base game play, as indicated block 204.

The gaming device 10 determines whether a bonus triggering symbol or symbol combination ("bonus trigger") for the first or main bonus game appears along a payline 56 or in a scatter arrangement, as described above and as indicated by diamond 206. If the base game play or spin of the reels 34 does not result in a bonus trigger for the first bonus game, gaming device 10 determines whether a bonus trigger for a second bonus game has been generated, as indicated by diamond 212. As with the payline dependent bonus games, the wager dependent gaming device 10 may be adapted to: (i) use only one bonus trigger for each bonus game; (ii) use a plurality of bonus triggers, wherein each triggers each bonus game; and (iii) use a plurality of bonus triggers, wherein each bonus game has a unique bonus trigger.

If the bonus trigger for the first bonus game is generated, gaming device 10 determines whether the player has wagered at least the first predefined number of credits, as indicated by diamond 208. If so, gaming device 10 initiates the first or main bonus game, which has a first average payout per credit bet, as indicated by block 210.

The first or main bonus game is preferably in accord with a theme of the gaming device 10. Being the main bonus game, it is likely to be the most complex, have the most interesting and intricate graphics and associated sound and have the highest average payout per credit wagered. As described above, for purposes of the present invention, the term "average payout per credit wagered" includes both the true average payout and the average payout per minimum bet average. In the wager or credit embodiments, however, the minimum average bet is the predefined number of credits rather than one credit times the predefined number of paylines.

If the first bonus trigger is generated, but the player has not wagered at least the first predefined number of credits, gaming device 10 determines whether the player has wagered at least a second predefined number of credits (on any payline combination desired by the player), which is less than the first predefined number, as indicated by diamond 214. If so, gaming device 10 initiates a second bonus game, which has a second average payout per credit bet, as indicated by block 216. The second average payout is preferably less than the first average payout per credit bet so that there remains a slight incentive to wager the higher number of credits.

Also, if the first bonus trigger is not generated, as determined in connection with diamond 206, but a second bonus trigger for the second bonus game has been generated, as indicated by diamond 212, and at least the second predefined number of credits has been wagered, as determined in connection with diamond 214 the gaming device 10 initiates the second bonus game, which has the second average payout per credit bet, as indicated by block 216. The second bonus game in one embodiment is thus generated by the same bonus trigger as is the first bonus game. In another embodiment, the second bonus game has its own bonus trigger. Preferably, only one embodiment is included in the same gaming device 10.

As above, the second bonus trigger does not have to have the same likelihood of generation as the first bonus trigger, but the likelihoods are preferably the same. The second bonus game preferably occurs with the same frequency as does the first or main bonus game. However, the same symbol or symbol combination does not have to be used for both games. The same symbol or symbol combination can, however, be used for both games and for each bonus game incorporated into gaming device 10.

These scenarios also exist for the third bonus game, as indicated by diamonds 218 and 220 and block 222. If one of either the first or second bonus triggers has occurred, as determined in connection with diamonds 206 and 212, respectively, but neither the first or second predefined number of credits has been wagered, as determined in connection with diamonds 208 and 214, respectively, the game determines whether the player has wagered a third predefined number of credits, as indicated by diamond 220, which is less than the second predefined number. If so, gaming device 10 initiates a third bonus game, which has a third average payout per credit bet, as indicated by block 222. The third average payout is preferably less than the second average payout per credit bet so that there remains a slight incentive to wager the higher number of credits.

As described above, if the first or second triggers are not generated, as determined in connection with diamonds 206 and 212, respectively, but a third bonus trigger for the third bonus game has been generated, as indicated by diamond 218, and at least the third predefined number of credits has been wagered, as determined in connection with diamond 220, the gaming device 10 initiates the third bonus game, which has the third average payout per credit bet, as indicated by block 222. The third bonus game in one embodiment is thus generated by the same symbol or combination as is the first or second bonus games. In another embodiment, the third bonus game has its own triggering symbol or combination. Preferably, again, only one of these embodiments is included in the same gaming device 10.

It should be appreciated that the credit or wager dependent bonus game embodiments can include more than three bonus games. To illustrate this feature, dotted lines are shown leading from diamonds 218 and 220 to an end of the gaming scheme of method 200. Preferably, each bonus trigger of gaming device 10 has the same probability or likelihood of being generated.

In one preferred embodiment, the first predefined number of credits or credits, discussed in connection with the oval 202, is the total possible number of credits or "max credits" as is commonly used in the industry. That is, the player must wager the maximum allowable amount of credits on each payline 56. No greater wager can be made than a max credit wager. The required wagers for the second and third bonus games in the preferred embodiment decrease accordingly from the max lines.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention claimed is:

1. A method of operating a gaming system, the method comprising:

causing at least one processor to execute a plurality of instructions to operate with at least one input device to accept one of a plurality of different wagers for a play of a primary game;

causing the at least one processor to execute the plurality of instructions to operate with at least one display device to display an outcome for the play of the primary game;

for the play of the primary game, causing the at least one processor to execute the plurality of instructions to operate with the at least one display device to display a first bonus game having a first average payout per credit wagered if:

(a) a first bonus game trigger symbol or symbol combination occurs in the play of the primary game, and (b) a first wager was made for the play of the primary game;

for the play of the primary game, causing the at least one processor to execute the plurality of instructions to operate with the at least one display device to display a second different bonus game having a second average payout per credit wagered, wherein the first average payout and the second average payout are different, if:

(a) a second bonus game trigger symbol or symbol combination occurs in the play of the primary game, wherein the first bonus game trigger symbol or symbol combination and the second bonus game trigger symbol or symbol combination are different, and (b) a second wager was made for the play of the primary game, wherein the first wager and the second wager are different; and for the play of the primary game, causing the at least one processor to execute the plurality of instructions to operate with the at least one display device to display the second different bonus game having the second average payout per credit wagered if:

(a) the first bonus game trigger symbol or symbol combination occurs in the play of the primary game, and (b) the second wager was made for the play of the primary game.

2. The method of claim 1, wherein the primary game is a slot game including a plurality of paylines, and the different wagers include wagers on different numbers of paylines.

3. The method of claim 2, which includes causing the at least one processor to execute the plurality of instructions to operate with the at least one input device to accept a wager on a maximum number of paylines for the play of the slot game and causing the at least one processor to execute the plurality of instructions to trigger a highest average payout in the first bonus game when the maximum number of paylines was wagered on for the play of the slot game.

4. The method of claim 2, wherein a first number of paylines activated is larger than a second number of paylines activated and the first average payout is larger than the second average payout.

5. The method of claim 1, which includes causing the at least one processor to execute the plurality of instructions to operate with the at least one input device to accept a maximum credit wager for the play of the primary game and causing the at least one processor to execute the plurality of instructions to trigger a highest average payout in the first bonus game when the maximum credit wager was made for the play of the primary game.

6. The method of claim 1, which includes causing the at least one processor to execute the plurality of instructions to operate with the at least one display device to display a third bonus game having a third average payout if the first bonus game trigger symbol or symbol combination occurs in the play of the primary game and causing the at least one processor to execute the plurality of instructions to operate with the at least one display device to display one of the first bonus game, the second bonus game, and the third bonus game based on a number of paylines wagered on for the play of the primary game if the third wager was made in the primary game.

7. The method of claim 6, wherein a second number of paylines activated is larger than a third number of paylines activated and the second average payout is larger than the third average payout.

8. The method of claim 1, which includes causing the at least one processor to execute the plurality of instructions to operate with the at least one display device to display the first and second bonus games if a plurality of bonus game triggers occur in the play of the primary game.

9. The method of claim 1, wherein the primary game is a poker game including a plurality of hands that may be simultaneously played and which includes causing the at least one processor to execute the plurality of instructions to operate with the at least one input device to accept wagers on different numbers of hands.

10. The method of claim 1, wherein the primary game is a poker game and which includes causing the at least one processor to execute the plurality of instructions to operate with the at least one input device to accept wagers on a varying number of credits per hand, wherein the different wagers include different amounts of credits wagered per hand.

11. The method of claim 1, wherein the primary game is a blackjack game including a plurality of hands that may be simultaneously played, and which includes causing the at least one processor to execute the plurality of instructions to operate with the at least one input device to accept wagers on different numbers of hands.

12. The method of claim 1, wherein the primary game is a keno game including a plurality of cards that may be simultaneously played, and which includes causing the at least one processor to execute the plurality of instructions to operate with the at least one input device to accept wagers on different numbers of cards.

13. The method of claim 1, wherein the primary game is a keno game including a plurality of numbers that may be simultaneously played, and wherein the different wagers include wagers on different amounts of numbers played.

14. The method of claim 1, which is provided through a data network.

15. The method of claim 14, wherein the data network is an internet.

16. A non-transitory computer readable medium including a plurality of instructions which, when executed by at least one processor, cause the at least one processor to:

(a) operate with at least one input device to accept one of a plurality of different wagers for a play of a primary game;

(b) cause at least one display device to display an outcome for the play of the primary game;

(c) for the play of the primary game, cause the at least one display device to display a first bonus game having a first average payout per credit wagered if:

(i) a first bonus game trigger symbol or symbol combination occurs in the play of the primary game, and (ii) a first wager was made for the play of the primary game;

(d) for the play of the primary game, cause the at least one display device to display a second different bonus game having a second average payout per credit wagered, wherein the first average payout and the second average payout are different, if:

(i) a second bonus game trigger symbol or symbol combination occurs in the play of the primary game, wherein the first bonus game trigger symbol or symbol combination and the second bonus game trigger symbol or symbol combination are different, and (ii) a second wager was made for the play of the primary game, wherein the first wager and the second wager are different; and (e) for the play of the primary game, cause the at least one display device to display the second different bonus game having the second average payout per credit wagered if:

(i) the first bonus game trigger symbol or symbol combination occurs in the play of the primary game, and (ii) the second wager was made for the play of the primary game.

17. The non-transitory computer readable medium of claim 16, wherein the primary game is a slot game including a plurality of paylines, and the different wagers include wagers on different numbers of paylines.

18. The non-transitory computer readable medium of claim 17, wherein the plurality of instructions, when executed by the at least one processor, cause the at least one processor to operate with the at least one input device to: (a) accept a wager on a maximum number of paylines for the play of the slot game, and (b) trigger a highest average payout in the first bonus game when the maximum number of paylines was wagered on for the play of the slot game.

19. The non-transitory computer readable medium of claim 17, wherein a first number of paylines activated is larger than a second number of paylines activated and the first average payout is larger than the second average payout.

20. The non-transitory computer readable medium of claim 16, wherein the plurality of instructions, when executed by the at least one processor, cause the at least one processor to operate with the at least one input device to: (a) accept a maximum credit wager for the play of the primary game, and (b) trigger a highest average payout in the first bonus game when the maximum credit wager was made for the play of the primary game.

21. The non-transitory computer readable medium of claim 16, wherein the plurality of instructions, when executed by the at least one processor, cause the at least one processor to: (a) cause the at least one display device to display a third bonus game having a third average payout if the first bonus game trigger symbol or symbol combination occurs in the play of the primary game, and (b) cause the at least one display device to display one of the first bonus game, the second bonus game, and the third bonus game based on a number of paylines wagered on for the play of the primary game if the third wager was made in the primary game.

22. The non-transitory computer readable medium of claim 21, wherein a second number of paylines activated is larger than a third number of paylines activated and the second average payout is larger than the third average payout.

23. The non-transitory computer readable medium of claim 16, wherein the plurality of instructions, when executed by the at least one processor, cause the at least one processor to cause the at least one display device to display the first and second bonus games if a plurality of bonus game triggers occur in the play of the primary game.

24. The non-transitory computer readable medium of claim 16, wherein the primary game is a poker game including a plurality of hands that may be simultaneously played, and wherein the plurality of instructions, when executed by the at least one processor, cause the at least one processor to operate with the at least one input device to accept wagers on different numbers of hands.

25. The non-transitory computer readable medium of claim 16, wherein the primary game is a poker game, and the plurality of instructions, when executed by the at least one processor, cause the at least one processor to operate with the at least one input device to accept wagers on a varying number of credits per hand, wherein the different wagers include different amounts of credits wagered per hand.

26. The non-transitory computer readable medium of claim 16, wherein the primary game is a blackjack game including a plurality of hands that may be simultaneously played, and the plurality of instructions, when executed by the at least one processor, cause the at least one processor to operate with the at least one input device to accept wagers on different numbers of hands.

27. The non-transitory computer readable medium of claim 16, wherein the primary game is a keno game including a plurality of cards that may be simultaneously played, and the plurality of instructions, when executed by the at least one processor, cause the at least one processor to operate with the at least one input device to accept wagers on different numbers of cards.

28. The non-transitory computer readable medium of claim 16, wherein the primary game is a keno game including a plurality of numbers that may be simultaneously played, and wherein the different wagers include wagers on different amounts of numbers played.

* * * * *

UNITED STATES PATENT AND TRADEMARK OFFICE

CERTIFICATE OF CORRECTION

PATENT NO. : 8,202,153 B2
APPLICATION NO. : 12/014354
DATED : June 19, 2012
INVENTOR(S) : Anthony J. Baerlocher It is certified that error appears in the above-identified patent and that said Letters Patent is hereby corrected as shown below:

IN THE CLAIMS

In Claim 6, Column 13, Line 42, replace the first instance of "the" with --a--.
In Claim 21, Column 15, Line 21, replace the first instance of "the" with --a--.

Signed and Sealed this
Twenty-ninth Day of January, 2013

David J. Kappos

David J. Kappos
*Director of the United States Patent and Trademark Office*